US007603802B2

(12) United States Patent
Oudekerk et al.

(10) Patent No.: US 7,603,802 B2
(45) Date of Patent: Oct. 20, 2009

(54) DISPLAY WITH MOVABLE COMPONENTS

(76) Inventors: Douglas R. Oudekerk, 2003 Goodrich Ave., Saint Paul, MN (US) 55105; John K. Lampe, 262 Griggs St. South, St. Paul, MN (US) 55105

( * ) Notice: Subject to any disclaimer, the term of this patent is extended or adjusted under 35 U.S.C. 154(b) by 44 days.

(21) Appl. No.: 11/633,920

(22) Filed: Dec. 5, 2006

(65) Prior Publication Data

US 2007/0124968 A1 Jun. 7, 2007

Related U.S. Application Data

(60) Provisional application No. 60/742,283, filed on Dec. 6, 2005, provisional application No. 60/802,048, filed on May 22, 2006.

(51) Int. Cl.
*B42F 17/34* (2006.01)

(52) U.S. Cl. ..... 40/375; 40/421; 40/445; 40/491

(58) Field of Classification Search ..... 40/375, 40/421, 124.08, 124.19, 445, 491, 488, 490; 446/152, 151, 150, 149, 148, 147; 434/405
See application file for complete search history.

(56) References Cited

U.S. PATENT DOCUMENTS

| | | | | |
|---|---|---|---|---|
| 1,262,998 | A | 4/1918 | Sumner | |
| 2,045,864 | A * | 6/1936 | Miller | 40/421 |
| 2,384,662 | A * | 9/1945 | Wehr | 446/152 |
| 2,432,318 | A | 12/1947 | Leech | |
| 2,844,898 | A * | 7/1958 | Youngren | 446/151 |
| 2,884,724 | A | 5/1959 | Lohnes et al. | |
| 3,318,040 | A | 5/1967 | Kindberg | |
| 4,976,647 | A * | 12/1990 | Axtell | 446/151 |
| 5,112,290 | A | 5/1992 | Hibsch | |
| 5,141,253 | A | 8/1992 | Rice | |
| 5,287,641 | A | 2/1994 | Showers | |
| 5,548,913 | A | 8/1996 | Randolph et al. | |
| 5,871,237 | A | 2/1999 | Hunt | |
| 5,988,684 | A | 11/1999 | Blaustein et al. | |
| 6,237,265 | B1 | 5/2001 | Crowell | |
| 6,796,061 | B2 | 9/2004 | Germma, Jr. | |
| 7,083,559 | B2 | 8/2006 | Castello et al. | |

OTHER PUBLICATIONS

David A. Carter et al., "The Elements of Pop-Up", 1999, Little Simon, New York.

* cited by examiner

*Primary Examiner*—Lesley D Morris
*Assistant Examiner*—Christopher E Veraa
(74) *Attorney, Agent, or Firm*—Sherrill Law Offices, PLLC

(57) ABSTRACT

In one embodiment, a display comprising: a sleeve having a first guide; a movable member that moves in relation to the sleeve, the movable member having a second guide; and a slider slidably secured to the first guide and slidably secured to the second guide; whereby movement of the member causes the first guide and the second guide to cooperate in directing movement of the slider. In another embodiment, a display comprising: a sheet having a front side and a back side; a rotatable member positioned on the front side' of the sheet; a wheel positioned on the back side of the sheet; a shaft extending through the sheet, the shaft joining the rotatable member to the wheel; and a member slidable in relation to the sheet and to the wheel, the member having a surface for contacting the wheel and causing the wheel and the rotatable member to rotate when the member slides.

1 Claim, 15 Drawing Sheets

DISPLAY WITH MOVABLE COMPONENTS

This application claims the benefit of U.S. Provisional Application Nos. 60/742,283 filed on Dec. 6, 2005 and 60/802,048 filed on May 22, 2006.

FIELD OF INVENTION

The present invention generally relates to a display with movable components. Specifically, it can relate to a greeting card with movable components.

BACKGROUND

Decorative displays such as a greeting cards with movable components are well known in the art. These can include, for example, cards that incorporate "pop-up," "view changing," or "pull out" features.

The prior art suffers from certain shortcomings or limitations. The purpose of the present invention is to overcome these and other shortcomings or limitations in the prior art.

SUMMARY OF THE INVENTION

The present invention generally relates to a decorative display with movable components. In at least one embodiment, the invention can be a greeting card comprising a sleeve having a front wall, a back wall, a closed end, and an open end. A sliding panel can be slid by hand in and at least part-way out of the open end of the sleeve. A distal end of the sliding panel can be oriented toward the closed end of the sleeve. The sliding of the sliding panel can cause a slider to move. The movement of the slider can be controlled by guides. The guides can be a wire guide attached to the sliding panel and a slot in the front wall of the sleeve. As a user pulls the sliding panel out of the sleeve (or pushes the sliding panel back into the sleeve), the guides (the wire rail and the slot) can control the movement of the slider such that the slider and the sliding panel can move in in different directions. The slider can incorporate a decorative item that forms a part of a moving decorative display.

The above summary of the present invention is not intended to describe each illustrated embodiment, object, advantage, or use of the present invention. The figures and the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

DETAILED DESCRIPTION OF THE INVENTION INCLUDING A BEST MODE

Nomenclature

Figure 1A:
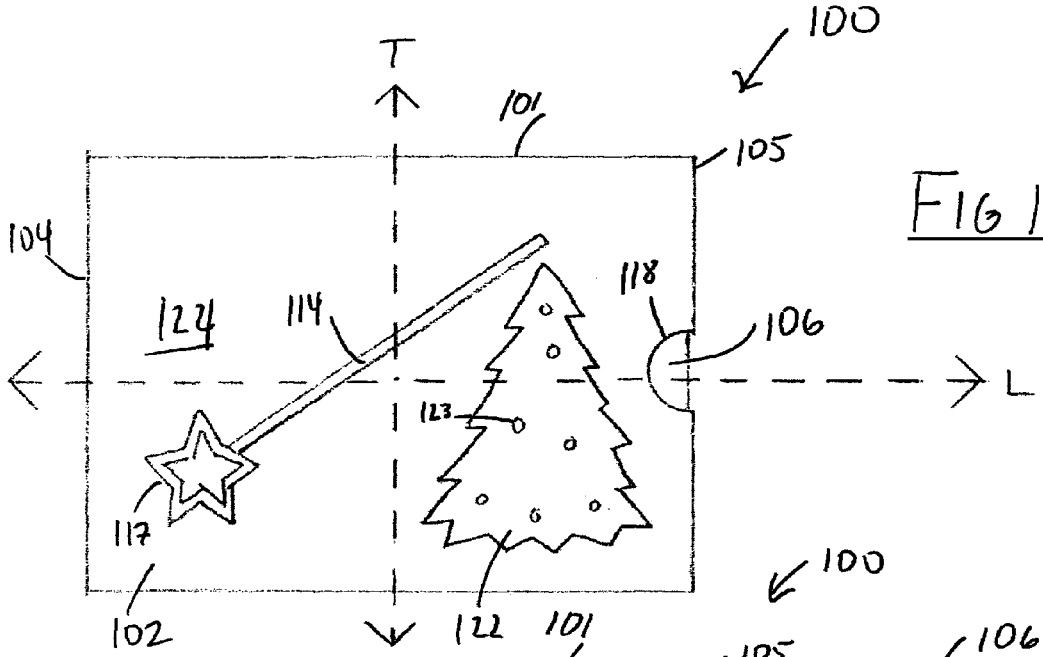
FIG. 1A is a plan view of a greeting card with movable components in a first position according to the first embodiment.

100 greeting card
101 sleeve
102 front wall
103 back wall
104 closed end
105 open end
106 sliding panel
107 distal end of sliding panel
108 proximate end of sliding panel
109 wire guide
110 back side of sliding panel

111 adhesive tape
112 slider
113 tube
114 slot
115 post
116 face
117 star decoration
118 indentation
119 first direction
120 second direction
121 right triangle
122 Christmas tree
123 Christmas tree lights
124 front side of front panel
125 front side of sliding panel
126 decorative or printed matter on sliding panel
200 greeting card
201 sleeve
206 sliding panel
212 slider with sun decoration
214 slot
230 overlay
231 pocket
232 lower end of slot
233 upper end of slot
300 greeting card
301 sleeve
306 sliding panel
312*a* slider decorated with airplane
312*b* slider decorated with automobile
312*c* slider decorated with ship
314*a* upper slot
314*b* middle slot
314*c* lower slot
319 first direction
400 greeting card
401 sleeve
406 sliding panel
412*a* slider with top half of heart
412*b* slider with bottom half of heart
414*a* upper slot
414*b* lower slot
419 first direction
420 second direction
440 heart shape
441 third direction
500 greeting card
501 sleeve
506 sliding panel
509 wire guide
512 slider decorated with rocket
514 slot
519 first direction
520 second direction
545 tip of rocket decoration
546 periphery of sleeve
600 greeting card
601 sleeve
602 front wall
603 back wall
604 closed end
605 open end
606 sliding panel
607 distal end of sliding panel
608 proximate end of sliding panel
610 back side of sliding panel
618 indentation
619 first direction
620 second direction
625 front side of sliding panel
650 rotating disk
651 folded portion of sliding panel
652 shaft
653 pulley
655 edge of folded portion
656 groove of pulley
657 right hand
658 left hand
659 hypnosis spiral
660 bushing
661 backing
700 greeting card
701 sleeve
706 sliding panel
719 first direction
750 rotating disk
751 folded portion of sliding panel
753 pulley
755 edge of folded portion
765 rack gearing
800 greeting card
801 sleeve
802 front sheet
803 back sheet
806 movable member
812 slider
814*a* first slot
814*b* second slot
815 shaft
819 direction of movement of movable member
870*a* first part of slider
870*b* second part of slider
871 flap As disclosed the invention concerns a greeting card or other decorative display. However, the invention is not limited to such uses. The structure of the greeting card may be useful for other purposes. Other purposes might include, for example, in children's books, brochures, or any other use where such a structure might be usable and beneficial. The invention should be understood to encompass these other uses although such other uses may not be discussed below.

FIRST EMBODIMENT

The greeting card 100 shown in FIGS. 1A to 1H can be oriented with a longitudinal centerline L generally bisecting the greeting card 100. The term "longitudinal" refers to a line, axis, or direction in the plane of the greeting card 100 that is aligned with the centerline L. The greeting card shown in FIG. 1A can further be oriented with a transverse (or lateral) centerline T that is perpendicular to the longitudinal centerline L. The term "transverse" refers to a line, axis, or direction in the plane of the greeting card 100 that is aligned with the centerline T. The greeting card 100 can further be oriented with a line z as shown in perspective in FIG. 1E, which is perpendicular to the plane formed by centerlines L and T and generally corresponds to the direction associated with the thickness dimension of the greeting card 100.

The length of the greeting card 100 is the maximum dimension measured parallel to the longitudinal centerline L in the longitudinal direction. The width of the greeting card 100 is the maximum dimension measured parallel to the transverse centerline T in the transverse direction. The thickness of the greeting card is the maximum "z" direction dimension measured parallel to the "z" axis.

When a range or interval is disclosed, the disclosure is intended to disclose both the endpoints and the intervals within the range. For example, a range of 0.005 to 0.010 includes 0.005, 0.006 and 0.010 within that range.

The greeting card 100 as shown in FIGS. 1A to 1H can comprise a sleeve 101 having a front wall 102, a back wall 103, a closed end 104, and an open end 105. The front side 124 of the front wall 102 can have decorative or printed matter such as a Christmas tree 122 on it. A sliding panel 106 can slide in and at least part-way out of the open end 105 of the sleeve 101 with a distal end 107 of the sliding panel 106 oriented toward the closed end 104 of the sleeve 101. The sliding panel 106 can also have a wire guide 109 affixed to it. The wire guide 109 can be affixed to the back side 110 of the sliding panel 106 with pieces of adhesive tape 111 or other fastening means. In addition, the sliding panel 106 can have decorative or printed matter 126 on its front side 125.

Figure 1B:
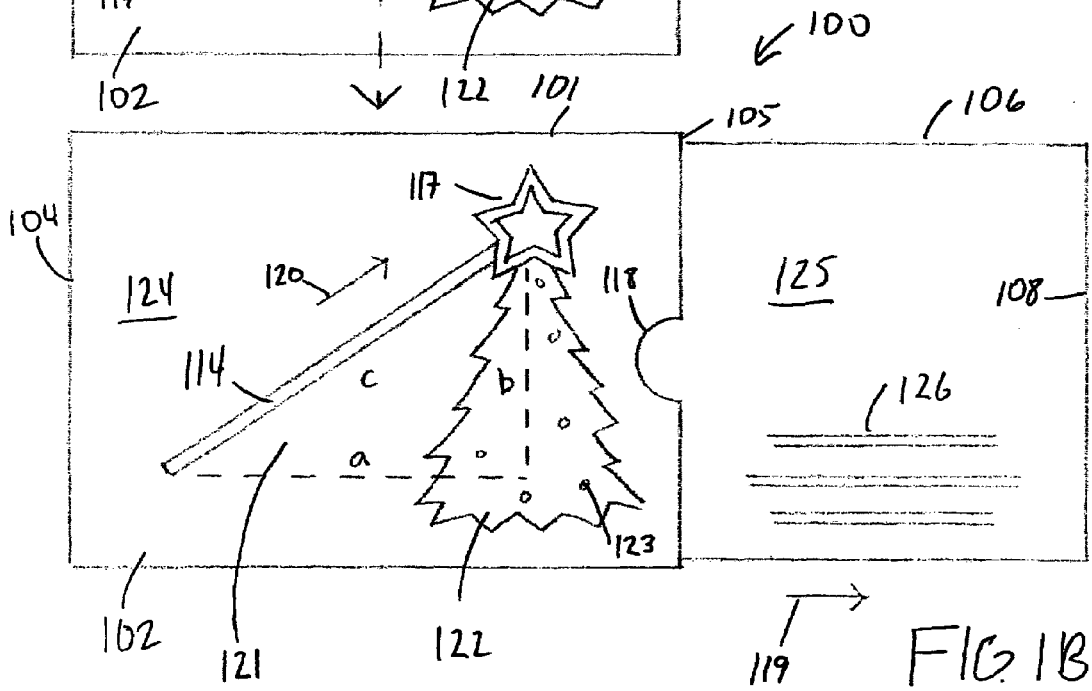
FIG. 1B is a plan view of a greeting card with movable components in a second position according to the first embodiment.
Figure 1C:
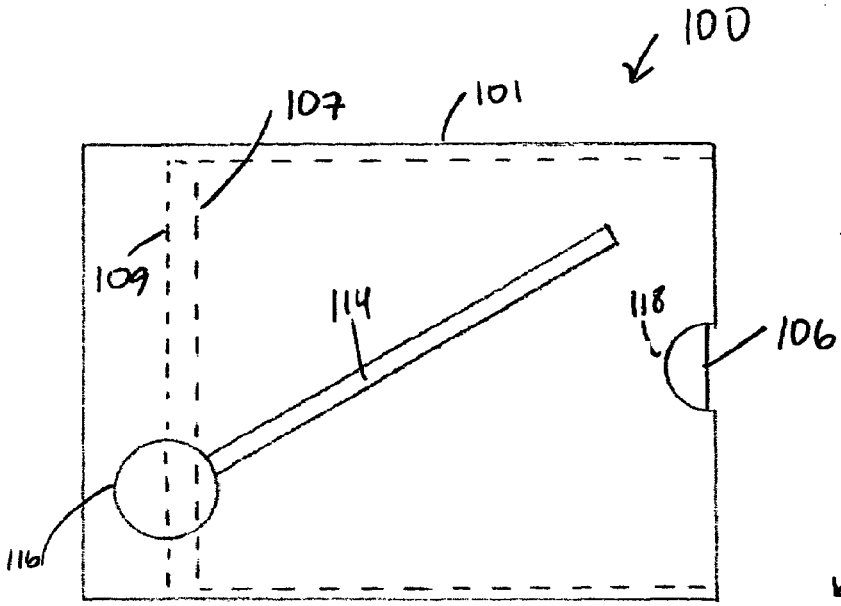
FIG. 1C is a plan view showing the internal workings of a greeting card with movable components in a first position according to the first embodiment.
Figure 1D:
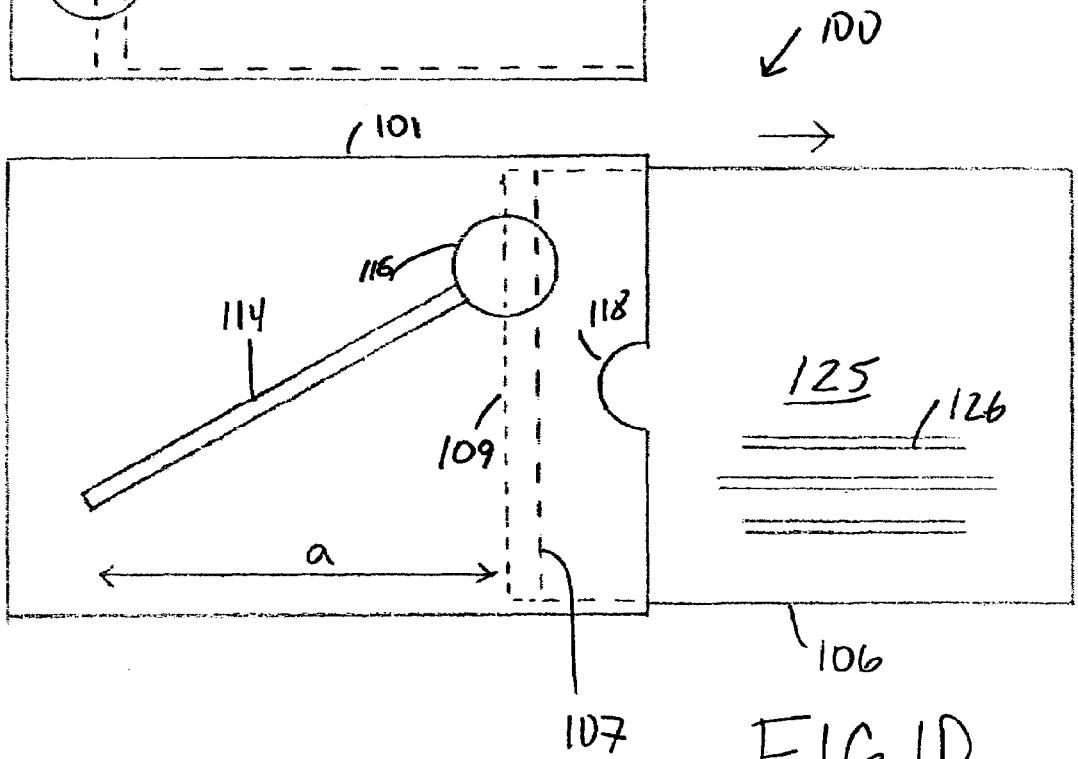
FIG. 1D is a plan view showing the internal workings of a greeting card with movable components in a second position according to the first embodiment.
Figure 1E:
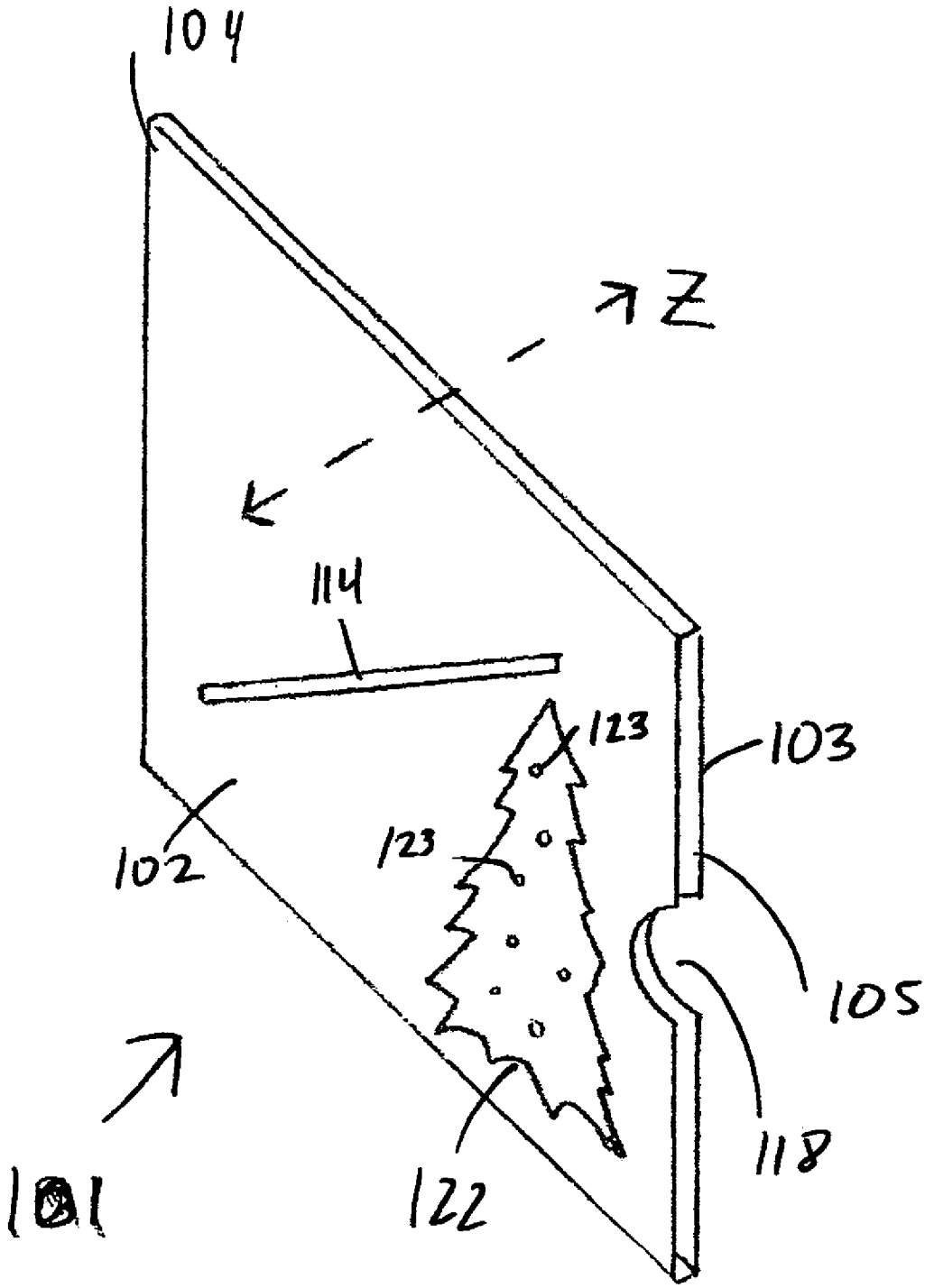
FIG. 1E is a perspective view of the sleeve of a greeting card according to the first embodiment.
Figure 1F:
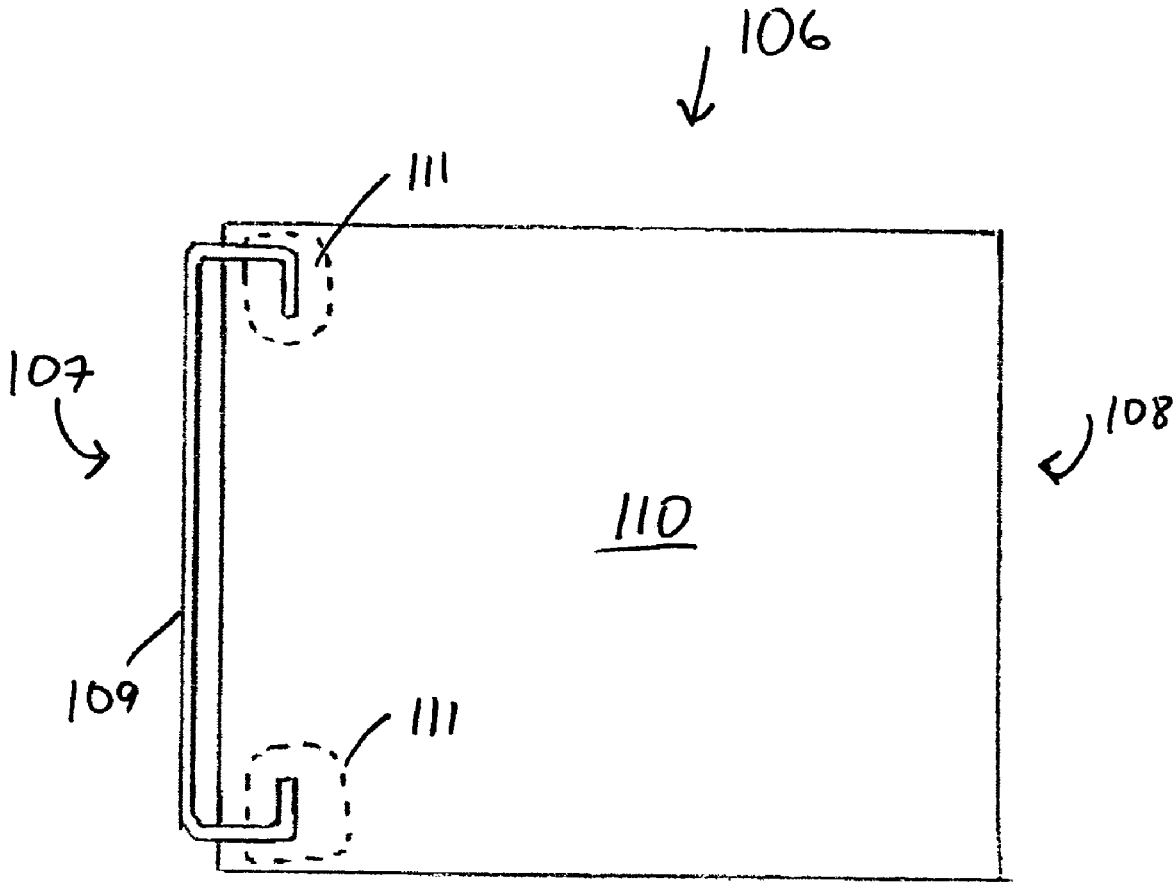
FIG. 1F is a plan view of the back side of the sliding panel of a greeting card according to the first embodiment.
Figure 1G:
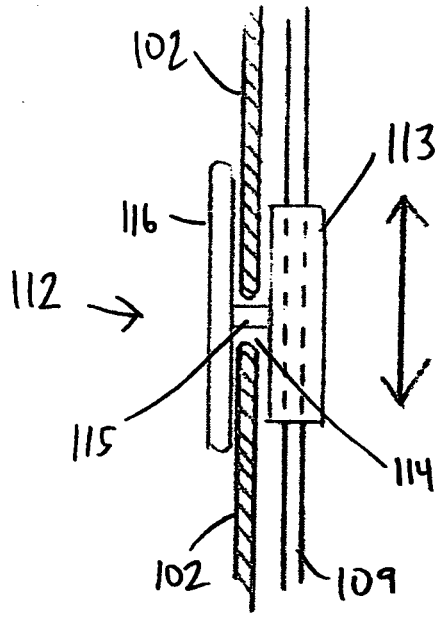
FIG. 1G is a side, partially cut-away view of the slider, a slot, and the guide of a greeting card according to the first embodiment.
Figure 1H:
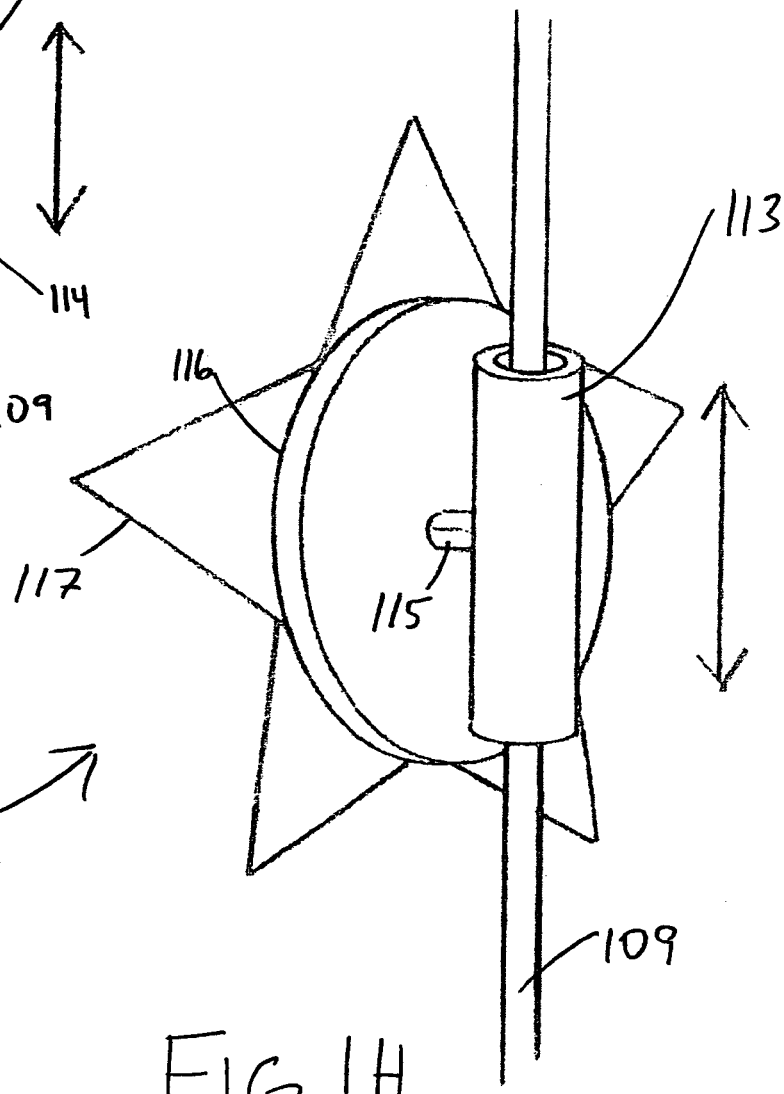
FIG. 1H is a perspective view of the back side of the slider mounted on the guide according to the first embodiment.

A slider 112 can slide on the wire guide 109. The slider 112 can, for example, have a tube 113 that fits around the wire guide 109. The tube 113 can fit sufficiently loosely on the wire guide 109 to allow the slider 112 to slide freely on the wire guide 109. The slider 112 can also be positioned and slide in a slot 114 in the front wall 102 of the sleeve 101. As shown in FIG. 1G, a post 115 integrated into the slider 112 can fit in the slot 114, and the post 115 can connect the tube 113 to a face 116 as shown in FIGS. 1G and 1H. The face 116 can serve two purposes: first, the face 116 along with the tube 113 can help keep the post 115 positioned in the slot 114. Second, the face 116 can serve as a surface to which items such as a star decoration 117 can be attached as shown in FIGS. 1A, 1B, and 1H.

The greeting card 100 can work as follows. The user can grasp (not shown) the card 100 at the indentation 118 on the sleeve 101. The user can pull the sliding panel 106 in a first direction 119. As the user pulls the sliding panel 106 in a first direction 119 out of the sleeve 101 (or pushes the sliding panel 106 back into the sleeve 101), both the wire guide 109 and the slot 114 can direct the slider 112 in a second direction 120. In this way the slider 112 and the sliding panel 106 can move in different directions 118, 119 but on planes (not indicated) that are generally parallel.

The slider 112 can also prevent the sliding panel 106 from sliding completely out of the sleeve 101 and becoming detached from the sleeve 101. Having the slider 112 slidably connected to both the wire guide 109 and the slot 114 can prevent this detachment under normal use.

The movement of the slider 112 in relation to the sliding panel 106 is also unique. When the user pulls out the sliding panel 106, the slider 112 can move farther than the sliding panel 106 moves. As shown in FIG. 1B, the sliding panel 106 can move a distance d. As shown in FIGS. 1C and 1D, the wire guide 109 moves a distance a. Because the wire guide 109 is rigidly affixed to the sliding panel 106 as shown in FIG. 1F, the wire guide 109 and the sliding panel 106 move approximately the same distance (i.e., a equals d). The distance a can be considered a side of a right triangle 121 along with sides b and c, with side c as the hypotenuse as shown in FIG. 1B. Because the slider 112 moves along c, the hypotenuse of the right triangle 121, and the sliding panel 106 only moves a distance equal to the length of side a of the right triangle 121, the slider 112 moving along c can be moved farther than the sliding panel 106.

The greeting card 100 and its components can be made of many different materials, many of which are well known in the art. For many applications, the sleeve 101 and the sliding panel 106 can be made of cardstock or similar materials. Preferably the material for the sleeve 101 and the sliding panel 106 should have some rigidity. For example, the slot 114 should be capable of guiding the slider 112 in the desired direction. If the material forming the slot 114 is not sufficiently stiff, the slider 112 could distort or even tear the front wall 102. The slot 114 can also be reinforced (not shown).

The kind of material used for the sleeve 101 and the sliding panel 106 will be determined by the application. For example, for some applications in which a more durable greeting is desirable, the sleeve 101 or the sliding panel 106 can be made of a stiffer plastic film. Even materials such as metal, glass, ceramic, wood or other pulp-based products (such as wood veneers) or fabrics (preferably treated to stiffen the fabric) could be suitable for some applications. Still other materials or combinations of materials may also be preferable for certain applications.

The slider 112 can also be made of many different materials, depending on the application. The slider 112 preferably can be made of a plastic of a kind suitable for injection molding. Injection molding or similar processes can allow the slider to be formed into a unitary piece. However, for certain applications other materials may be suitable. Materials such as other kinds of plastics, metals, glass, ceramic, wood or other pulp-based products can be suitable. Still other materials or combinations of materials may also be preferable for certain applications.

As discussed above, the wire guide 109 can be a separate component which is then affixed to the sliding panel 106. For such a configuration, the wire guide 109 can be tubular shaped wire stock or round plastic stock. Still other materials or combinations of materials may also be preferable for certain applications.

The overall size of the greeting card 100 can vary depending on the application. For example, the greeting card 100 can be slightly smaller than 5 inches wide by 7 inches long (allowing the greeting card 100 to fit in a 5 inch wide by 7 inch long envelope (not shown)). Larger or smaller sized greeting cards 100 than those described may be suitable for various other applications.

The shape of the greeting card 100 and its parts can also vary depending on the application. For most applications, the greeting card 100 can preferable have a rectangular shape. However, for other applications other shapes may be preferable.

The greeting card 100 can be assembled in many different ways. For example, the sleeve 101 can be cut from a unitary sheet stock (not shown) and folded to form the sleeve 101 and held in place with adhesives (not indicated). The slider 112 can be inserted onto the wire guide 109 before the wire guide 109 is attached to the sliding panel 106.

The greeting card 100 as disclosed above can have many uses and can offer several advantages. First, as discussed above, the operation of the greeting card 100 can move the slider 112 in a direction 119 different from the direction 120 in which the sliding panel 106 is pulled. This can unexpected movement can draw the attention and arouse the curiosity of the recipient of the card. Second, the slider 112 can move farther than the distance the sliding panel 106 is pulled. This maximizes use of the space on the front wall 102 of the greeting card 100 and adds another unique element to the greeting card 100. Third, the greeting card 100 can be made to operate very smoothly, allowing the recipient to pull-out and push-in the sliding panel 106 easily and repeatedly. Third, the greeting card 100 can be made of materials that make the greeting card 100 very durable. For example, plastic films and injection molded components can extend the life of the greeting card 100. Fourth, the greeting card 100 can be manufactured economically. Unlike many pop-up cards (not shown), for example, the greeting card 100 can be made without a substantial number of cuts, components, or secondary operations.

Other embodiments (not shown) can have different configurations than those described above. For example, sliders (not shown) can be configured differently especially if the guides (e.g., the slot 114 and the wire guide described above) are configured differently. For instance, the guides could be two slots (not shown) instead of the wire guide 109 and the slot 114 described above. Two wire guides (not shown) could be used. For other applications different kinds of guides such as channels, grooves, and the like (not shown) could be used as guides for sliders and be. within the scope of the invention.

Other embodiments (not shown) can have sleeves that can be configured differently. These other configurations can control in a different way the direction or the way in which the sliding panel slides in relation to the sleeve. These other configurations could include sleeves with tracks or guides; sleeves that only partially enclose a sliding panel; sleeves with open backs or fronts or partially open backs or front. Such variations can still be within the scope of the invention.

Other embodiments (not shown) can have sliding panels that can be configured differently. The sliding panel can have tracks or guides; the sliding panel can have openings cut in it; or the sliding panel can have different shapes than a rectangle. The sliding panel can have different structures attached to it such as tabs and so forth. Such variations can still be within the scope of the invention.

The greeting card 100 could also have additional features not shown or described above. For example, a lighting system (not indicated) and a switch (not shown) could be added to the star decoration 117 and the Christmas tree 122 shown in FIGS. 1A and 1B. When the star 117 is moved to the top of the Christmas tree 122, for example, a switch could light the star 117 or Christmas tree lights 123. Sound chips (not shown), vibrating mechanisms (not shown), and so forth could also be added in additional embodiments. Such variations can still be within the scope of the invention.

Still other features not discussed above can include various decorative or printed matter formed in different ways. For example, messages or decorative matter could be created using glitter, additional cardstock, embossing, three-dimensional objects attached with adhesive, and so forth (not shown). Such variations can still be within the scope of the invention.

In addition, as discussed above, the invention is not limited to structures useful for greeting cards. Other embodiments can include applications of the invention for decorative displays such as ones that might be used in children's books, advertising, bulk mail solicitations, and the like.

Many other embodiments can have still other features than those described above. Some of those other features or configurations are discussed below.

SECOND EMBODIMENT

Figure 2A:
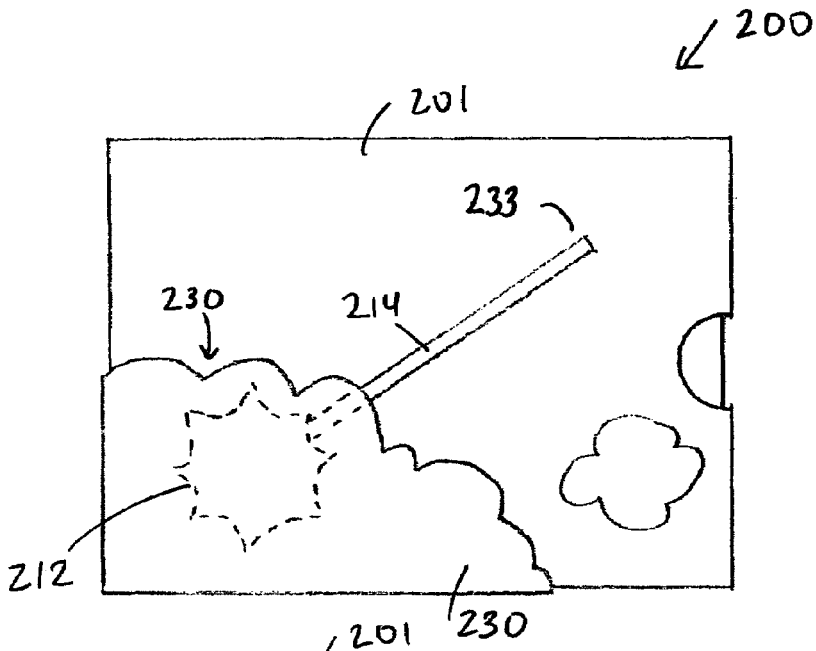
FIG. 2A is a plan view of a greeting card with movable components in a first position according to the second embodiment.
Figure 2B:
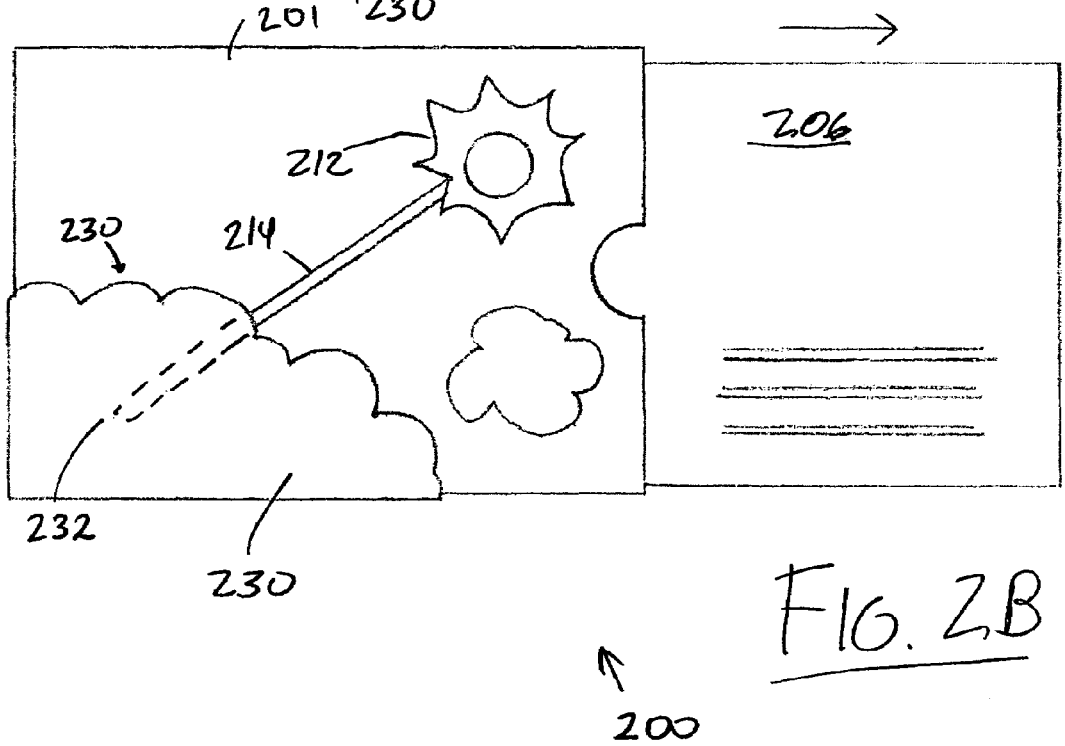
FIG. 2B is a plan view of a greeting card with movable components in a second position according to the second embodiment.

FIGS. 2A and 2B show a greeting card 200 according to a second embodiment. The greeting card 200 can substantially resemble the one shown in relation to FIG. 1A to 1E with at least these differences. The greeting card 200 can have a slider decorated with a sun 212. When the slider 212 is at the lower end 232 of the slot 214, the slider 212 can be obscured by an overlay 230 representing, for example, clouds. (Creating an image of the sun obscured by clouds.) The overlay 230 can be made from a separate piece of material such as cardstock affixed to the sleeve 201. The overlay 230 can form a pocket 231 into which the slider 212 can fit. When the slider 212 is moved toward the upper end 233 of the slot 214, the sun on the slider 212 can be fully visible.

FIGS. 2A and 2B greeting card 200 shows how a slider 212 can be fully obscured (or partially obscured in other embodiments not shown here) and then revealed by a user. Such a greeting card 200 or others resembling it (not shown) can be used with a variety of other decorative or printed matter to convey many different messages with different meanings.

THIRD EMBODIMENT

Figure 3A:
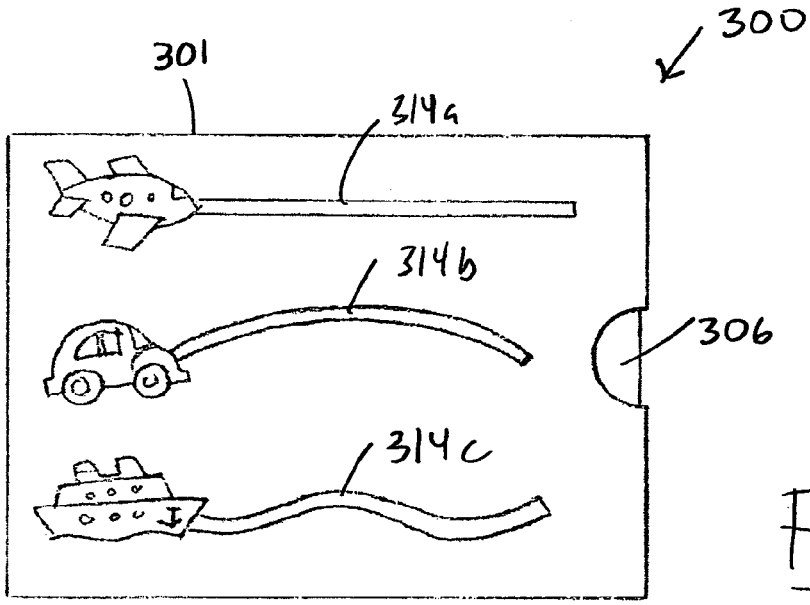
FIG. 3A is a plan view of a greeting card with movable components in a first position according to the third embodiment.
Figure 3B:
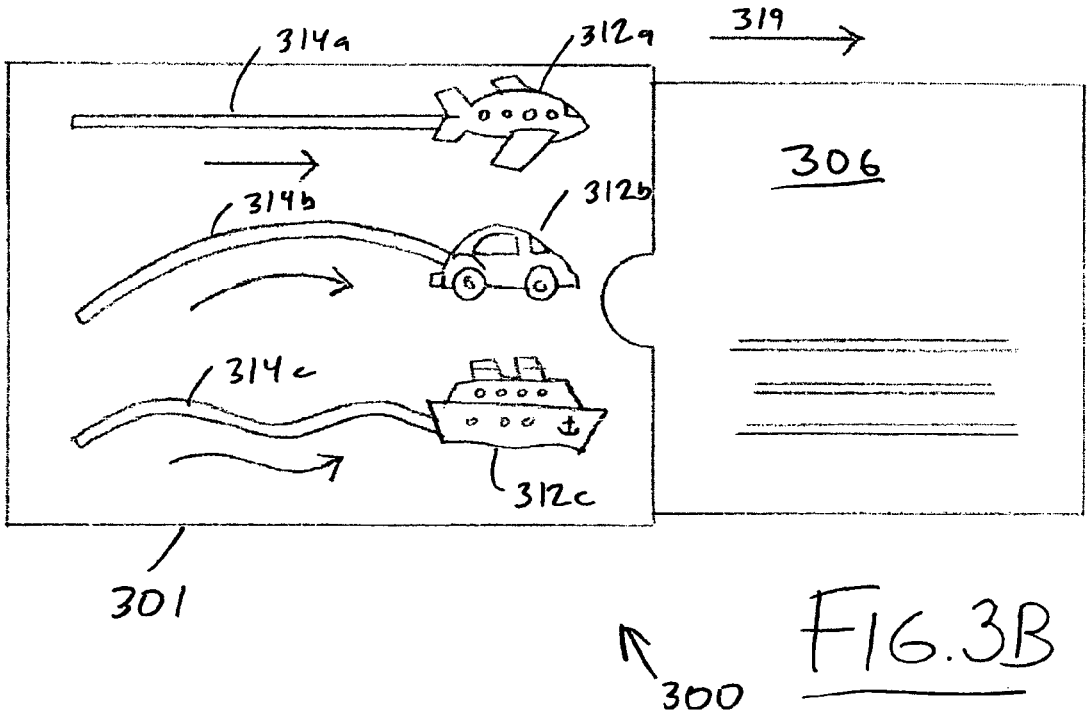
FIG. 3B is a plan view of a greeting card with movable components in a second position according to the third embodiment.

FIGS. 3A and 3B show a greeting card 300 according to a third embodiment. The greeting card 300 can substantially resemble the one shown in relation to FIG. 1A to 1E with at least these differences. The greeting card 300 can have three sliders 312*a* (decorated with an airplane), 312*b* (decorated with an automobile), and 312*c* (decorated with a ship). The sliders 312*a* to 312*c* can be slidably connected to a single wire guide (not shown but resembling the wire guide 101 shown in relation to FIGS. 1A to 1H). In addition, the sliders 312*a* to 312*c* can be positioned in three slots, 314*a*, 314*b*, and 314*c*. The slots 314*a* to 314*c* have different shapes. The lower slot 314*c* can have a wave shape; the middle slot 314*b* can have an arc shape; and the upper slot 314*a* can have a straight shape. By pulling out or pushing in the sliding panel 306 from the sleeve 301, the user can simultaneously cause three uniquely decorated sliders 312*a* to 312*c* to move in different ways.

Other embodiment (not shown) could employ still more slot patterns with even more sliders (not shown). The primary limitation on the number of slots and sliders would be the size of the greeting card or other display.

FOURTH EMBODIMENT

Figure 4A:
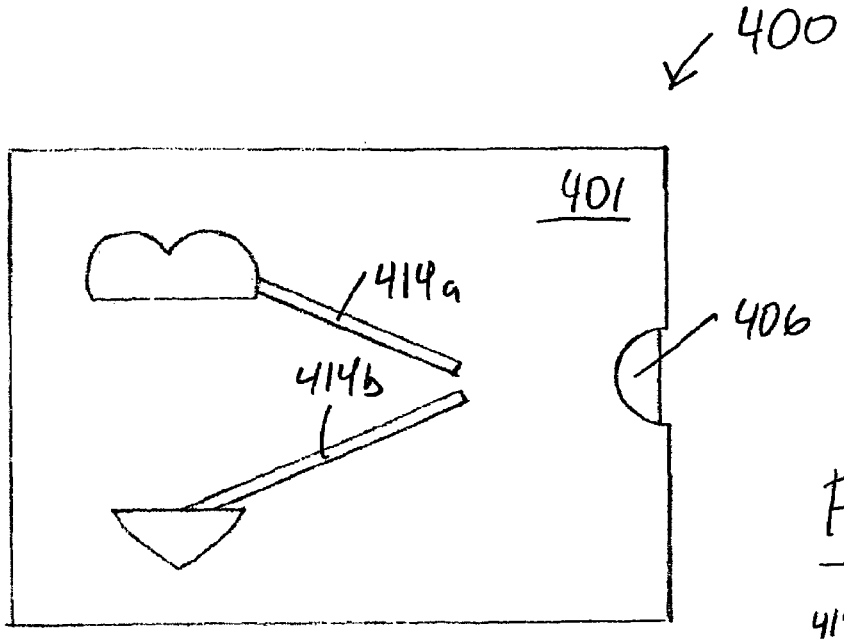
FIG. 4A is a plan view of a greeting card with movable components in a first position according to the fourth embodiment.
Figure 4B:
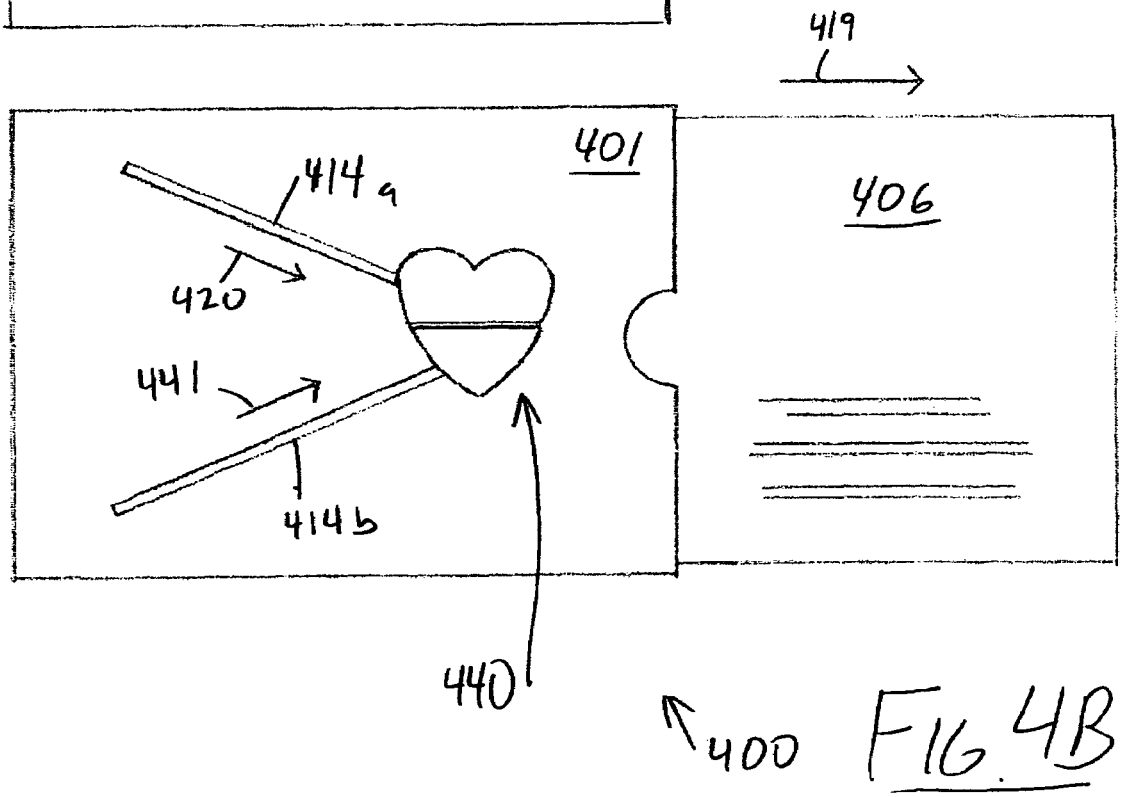
FIG. 4B is a plan view of a greeting card with movable components in a second position according to the fourth embodiment.

FIGS. 4A and 4B show a greeting card 400 according to a fourth embodiment. The greeting card 400 can substantially resemble the one shown in relation to FIG. 1A to 1E with at least these differences. The greeting card 400 can have two slots 414*a* and 414*b* that nearly converge as shown in FIGS. 4A and 4B. The greeting card 400 can have two decorated sliders 412*a* and 412*b*, with slider 412*a* decorated with a top half of a heart and slider 412*b* decorated with a bottom half of a heart. When the sliding panel 406 is moved in a first direction 419, the sliders 412*a* and 412*b* can be caused to converge forming a completed heart image 440.

Other embodiment (not shown) could employ other slot patterns and sliders that use other slot patterns and differently shaped sliders to form other images when a sliding panel is pulled or pushed.

FIFTH EMBODIMENT

Figure 5A:
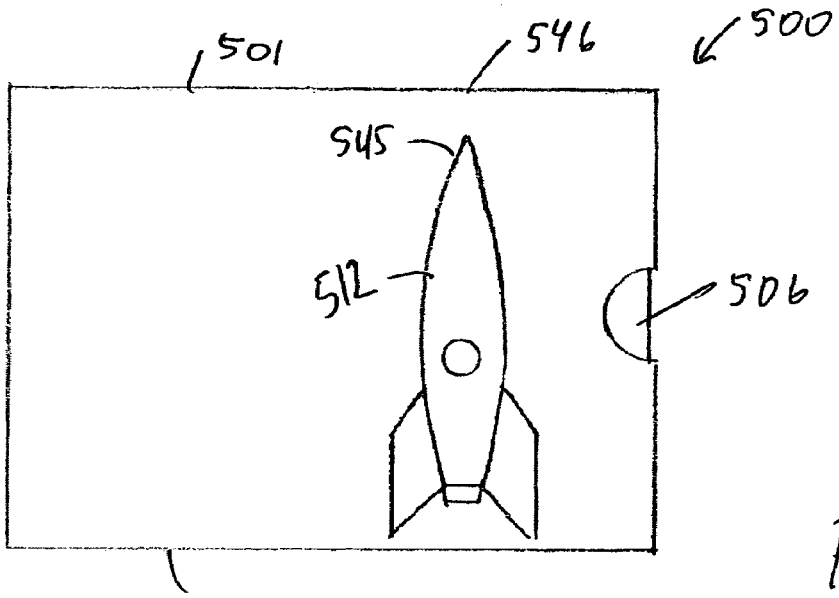
FIG. 5A is a plan view of a greeting card with movable components in a first position according to the fifth embodiment.
Figure 5B:
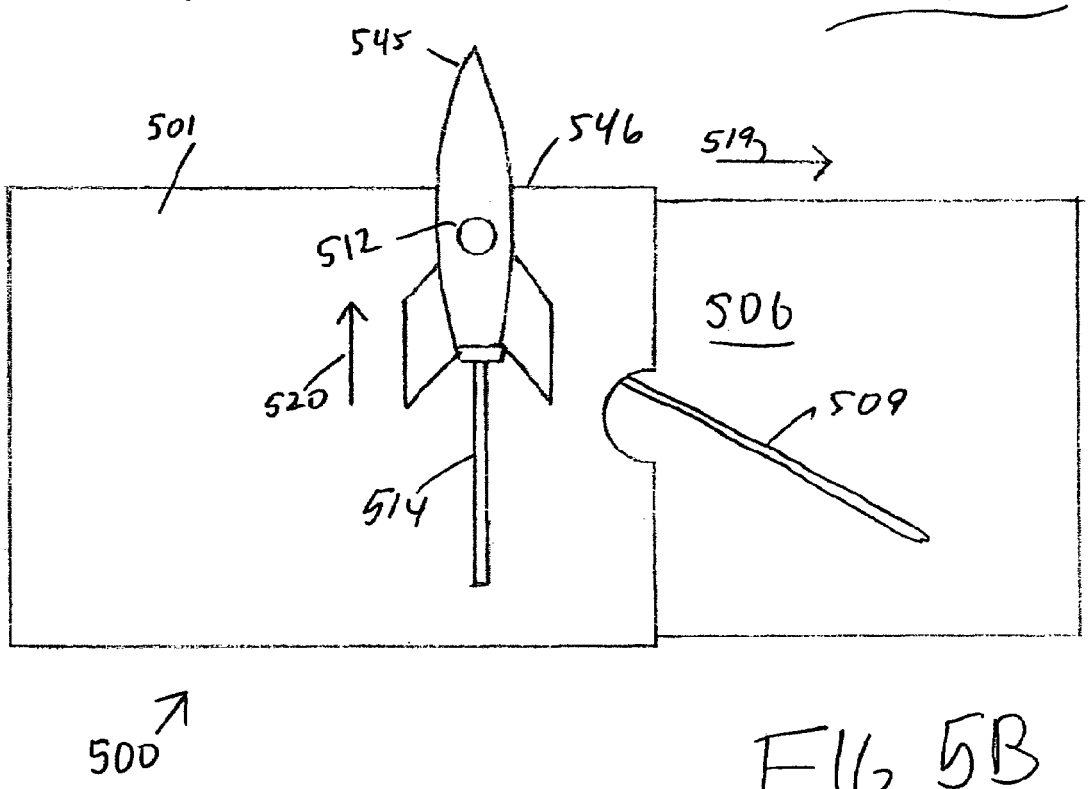
FIG. 5B is a plan view of a greeting card with movable components in a first position showing interior details according to the fifth embodiment.
Figure 5C:
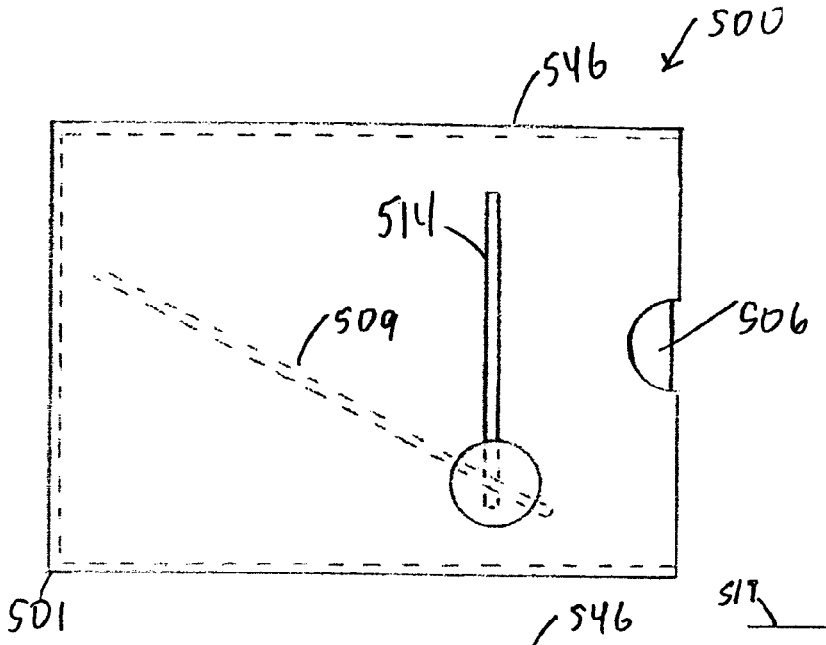
FIG. 5C is a plan view showing interior details of a greeting card with movable components in a first position according to the fifth embodiment.
Figure 5D:
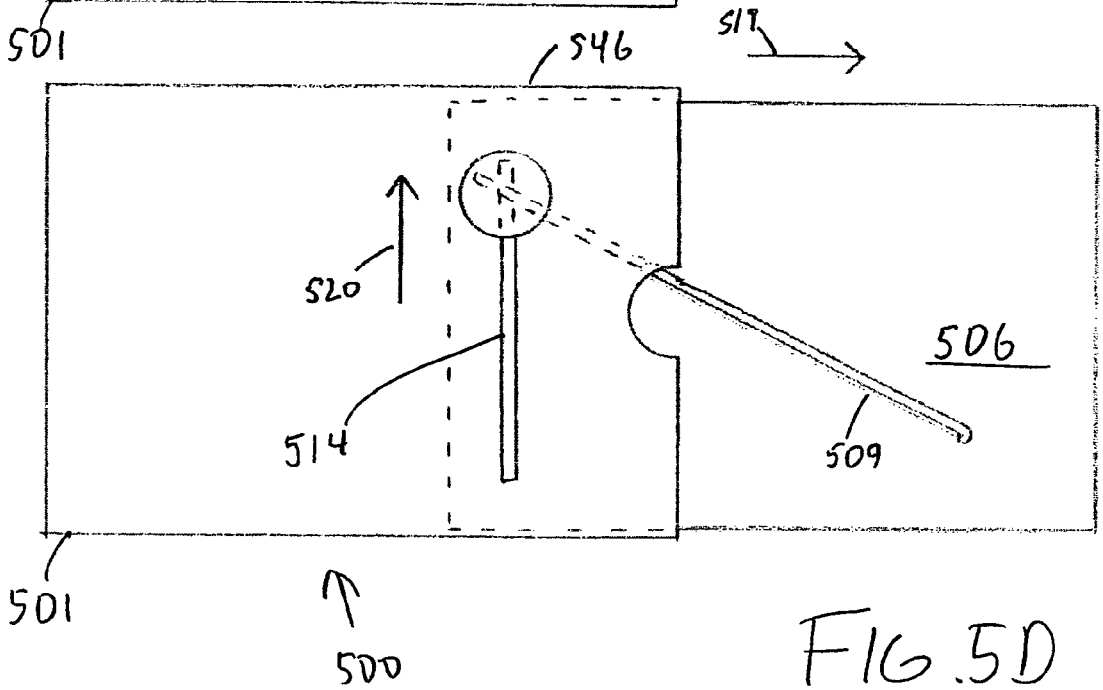
FIG. 5D is a plan view showing interior details of a greeting card with movable components according to the fifth embodiment.

FIGS. 5A to 5D show a greeting card 500 according to a fifth embodiment. The greeting card 500 can substantially resemble the one shown in relation to FIG. 1A to 1E with at least these differences. The slot 514 can be positioned transversely to the length of the greeting card 500. The wire guide 509 can run at an angle to length of the card 500. A slider can be decorated with a rocket 512. As the sliding panel 506 is pulled out in a first direction 519, the rocket decoration 517 can move in a second direction 520 in the slot 514, appearing to "blast-off." The second direction 520 can be substantially perpendicular to the first direction 519. Moreover, the tip 545 of the rocket decoration 517 can move outside the periphery 546 of the sleeve 501 as shown in FIG. 5B.

SIXTH EMBODIMENT

Figure 6A:
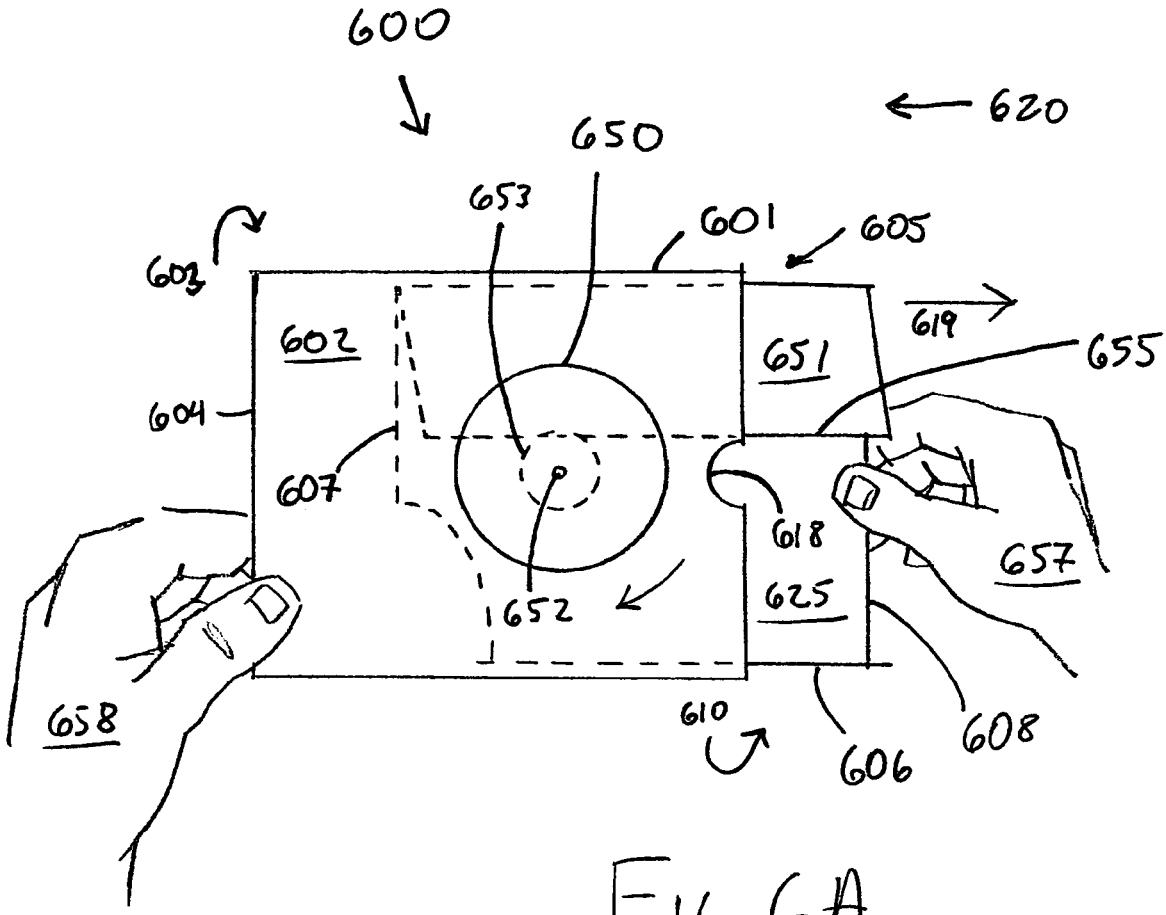
FIG. 6A is a view of the front side of the greeting card held in the hands of a recipient according to the sixth embodiment.
Figure 6B:
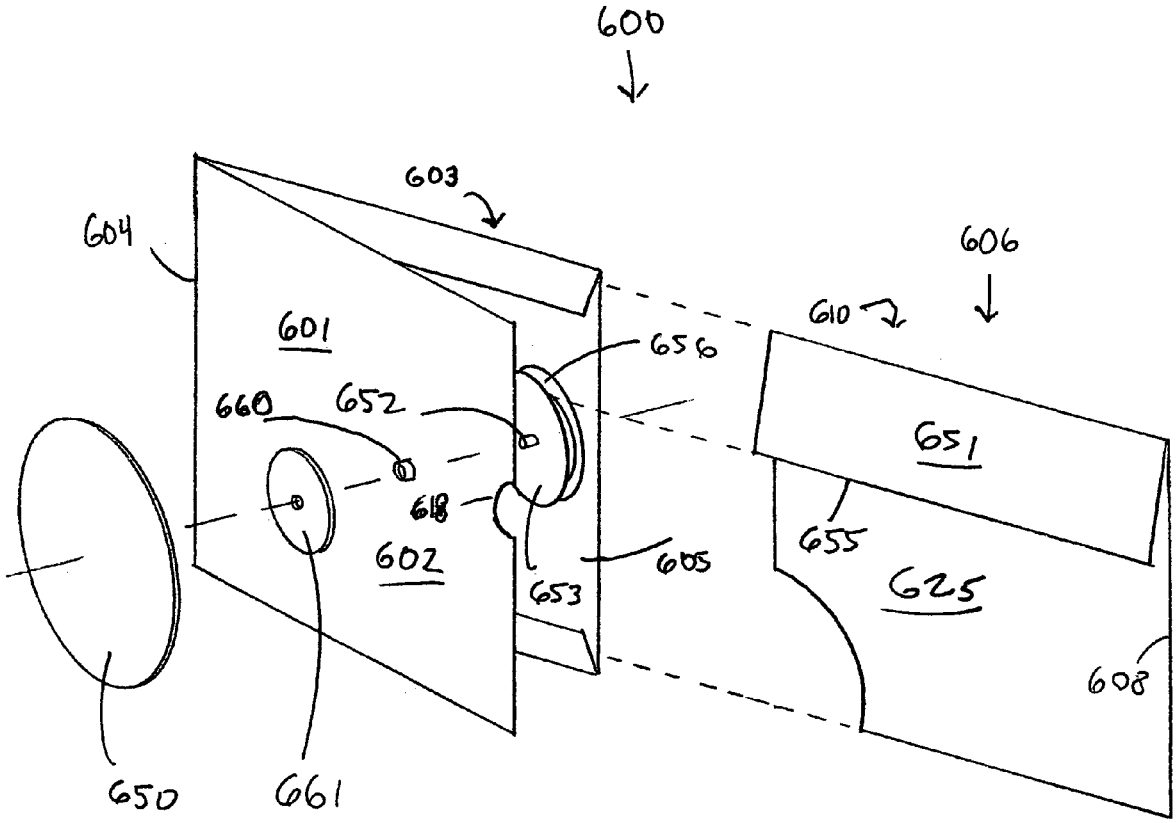
FIG. 6B is a perspective, exploded view of the greeting card according to the sixth embodiment.
Figure 6C:
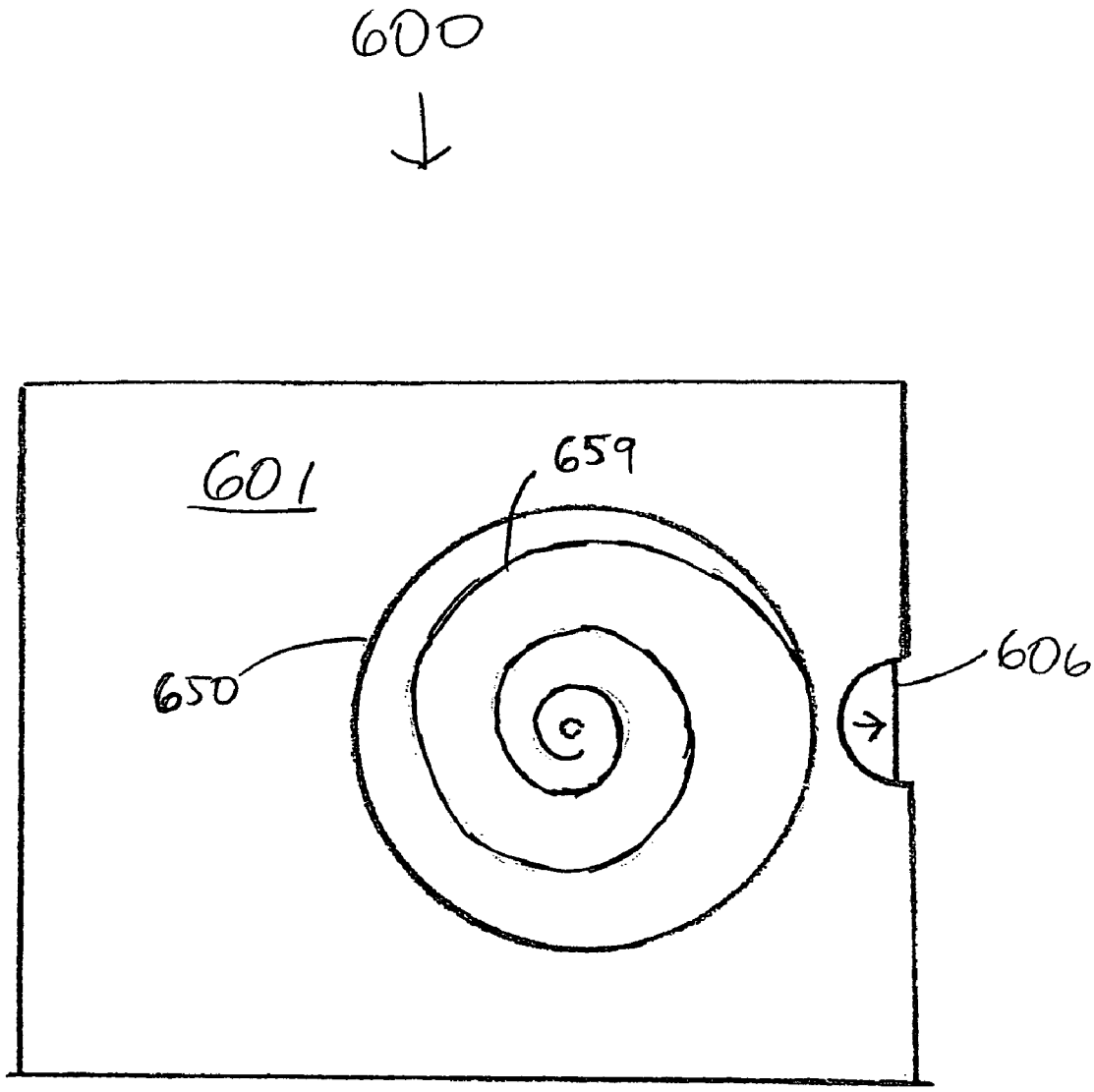
FIG. 6C is a plan view of the front side of the greeting card according to the sixth embodiment.

FIGS. 6A to 6C show a greeting card 600 according to a sixth embodiment. The greeting card 600 can substantially resemble the ones shown in relation to FIGS. 1A to 1E, FIGS. 2A and 2B, FIGS. 3A and 3B, FIGS. 4A and 4B, or FIGS. 5A to 5D with at least these differences. The greeting card 600 as shown in FIGS. 6A to 6C can comprise a sleeve 601 having a front wall 602, a back wall 603, a closed end 604, and an open end 605. A sliding panel 606 can slide in and at least part-way out of the open end 605 of the sleeve 601 with a distal end 607 of the sliding panel 606 oriented toward the closed end 604 of the sleeve 601.

A rotating member, in this embodiment, a rotating disk 650, can be positioned on the front side of the greeting card 600. The rotating disk 650 can be attached to attached to a piece of backing 661. The backing can be attached to a shaft 652 that in turn connects to a pulley 653. The pulley 653 can be positioned inside the sleeve 601. The shaft 652 can rotate in a bushing 660.

The sliding panel 606 can have a folded portion 651. An edge 655 of the folding portion 651 can fit within the groove 656 of the pulley 653. The edge 655 can fit snugly in the groove 656.

The greeting card 600 can work as follows. The user can hold the closed end 604 of the sleeve 601 in the left hand 658. The user can grasp the sliding panel 606 in the user's right hand 657 at the indentation 618 on the sleeve 101. The user can pull the sliding panel 606 in a first direction 619. As the user pulls the sliding panel 606 in a first direction 619 out of the sleeve 601 (or pushes the sliding panel 606 back into the sleeve 601), the edge 655 of the folded portion 651 can ride in groove 656 of the pulley 653. This can turn the pulley 653 thereby turning the rotating disk 650. (To improve rotation, gripping material (not shown) such as a gasket or other rubber-like material can fit in or be applied in the groove 656 to improve traction of the edge 655 in the groove 656.)

The rotating disk 650 can have decorative matter printed on it. For example, the rotating disk 650 can have a rotating "hypnosis spiral" 659 printed on it. It also could have many other images printed or otherwise depicted on it too. In addition, the front side 624 of the front wall 602 can have decorative or printed matter (not shown) on it. Finally, the sliding panel 606 can have decorative or printed matter (not shown) on its front side 625.

The greeting card 600 and its components can be made of many different materials, many of which are well known in the art. For many applications, the sleeve 601, the sliding panel 606, and the rotating disk 650 can be made of cardstock or similar materials. Preferably the material for the sleeve 601, the sliding panel 606, and the disk 650 should have some rigidity. For example, the disk 650 should be sturdy enough to survive mailing. In addition, the front wall 602 of the sleeve 601 should be sturdy enough to support the bushing 660.

The kind of material used for the sleeve 601 and the sliding panel 606 will be determined by the application. For example, for some applications in which a more durable greeting is desirable, the sleeve 601 or the sliding panel 606 can be made of a stiffer plastic film. Even materials such as metal, glass, ceramic, wood or other pulp-based products (such as wood veneers) or fabrics (preferably treated to stiffen the fabric) could be suitable for some applications. Still other materials or combinations of materials may also be preferable for certain applications.

The pulley 653, the shaft, 652, the backing 661, and the bushing 660 can also be made of many different materials, depending on the application. These components preferably can be made of a plastic of a kind suitable for injection molding. Injection molding or similar processes can allow the pulley 653 and the shaft 652 to be formed into a unitary piece. However, for certain applications other materials may be suitable. Materials such as other kinds of plastics, metals, glass, ceramic, wood or other pulp-based products can be suitable. Still other materials or combinations of materials may also be preferable for certain applications.

The overall size of the greeting card 600 can vary depending on the application. For example, the greeting card 600 can be slightly smaller than 5 inches wide by 7 inches long (allowing the greeting card 600 to fit in a 5 inch wide by 7 inch long envelope (not shown)). Larger or smaller sized greeting cards 600 than those described may be suitable for various other applications.

The shape of the greeting card 600 and its parts can also vary depending on the application. For most applications, the greeting card 600 can preferable have a rectangular shape. However, for other applications other shapes may be preferable.

The greeting card 600 can be assembled in many different ways. For example, the sleeve 101 and the sliding panel 606 can each be cut from a unitary sheet stock (not shown) and folded respectively to form the sleeve 601 and the sliding panel 606 and held in place with adhesives (not indicated).

The greeting card 600 as disclosed above can have many uses and can offer several advantages. First, the rotating disk 650 can rotate smoothly in the bushing 660. This can be pleasurable for the recipient of the greeting card 600. Second, the sliding panel 606 can be pushed in-and-out repeatedly allowing the recipient or others to enjoy the greeting card 600. Third, the greeting card 600 can be made of materials that make the greeting card 600 very durable. For example, plastic films and injection molded components can extend the life of the greeting card 600. Fourth, the greeting card 600 can be manufactured economically. Unlike many pop-up cards (not shown), for example, the greeting card 600 can be made without a substantial number of cuts, components, or secondary operations.

Other embodiments (not shown) can have different configurations than those described above. For example, a more economical version of the greeting card (not shown) could be manufactured without the bushing 660. The shaft 652 could simply rotate in a hole in the sleeve 601.

Other embodiments could have a rotating member with different decorative matter than shown in FIG. 6C. Still other embodiments could have a rotating member of a shape different than the rotating disk 650 shown in FIGS. 6A to 6C. For example, the rotating member could have many other shapes (not shown) including a rectangular shape, an octagonal shape, an oval shape, a pendulum shape, and so forth.

Other embodiments (not shown) can have a sliding panel that can be configured differently. An alternative sliding panel can have tracks or guides that allow it to slide; the sliding panel can have openings cut in it; or the sliding panel can have different shapes than a rectangle. The sliding panel can have different structures attached to it such as tabs and so forth. Such variations can still be within the scope of the invention.

The greeting card 600 could also have additional features not shown or described above. For example, a lighting system (not indicated) and a switch (not shown) could be integrated into the greeting card 600. When the rotating disk 650 is rotated, a light (not shown) could turn on. Many other devices including sound chips (not shown), vibrating mechanisms (not shown), and so forth could be added in additional embodiments. Such variations can still be within the scope of the invention.

Still other features not discussed above can include various decorative or printed matter formed in different ways. For example, messages or decorative matter could be created using glitter, additional cardstock, embossing, three-dimensional objects attached with adhesive, and so forth (not shown). Such variations can still be within the scope of the invention.

In addition, as discussed above, the invention is not limited to structures useful for greeting cards. Other embodiments can include applications of the invention for decorative displays such as ones that might be used in children's books, advertising, bulk mail solicitations, and the like.

Many other embodiments can have still other features than those described above. Some of those other features or configurations are discussed below.

SEVENTH EMBODIMENT

Figure 7A:
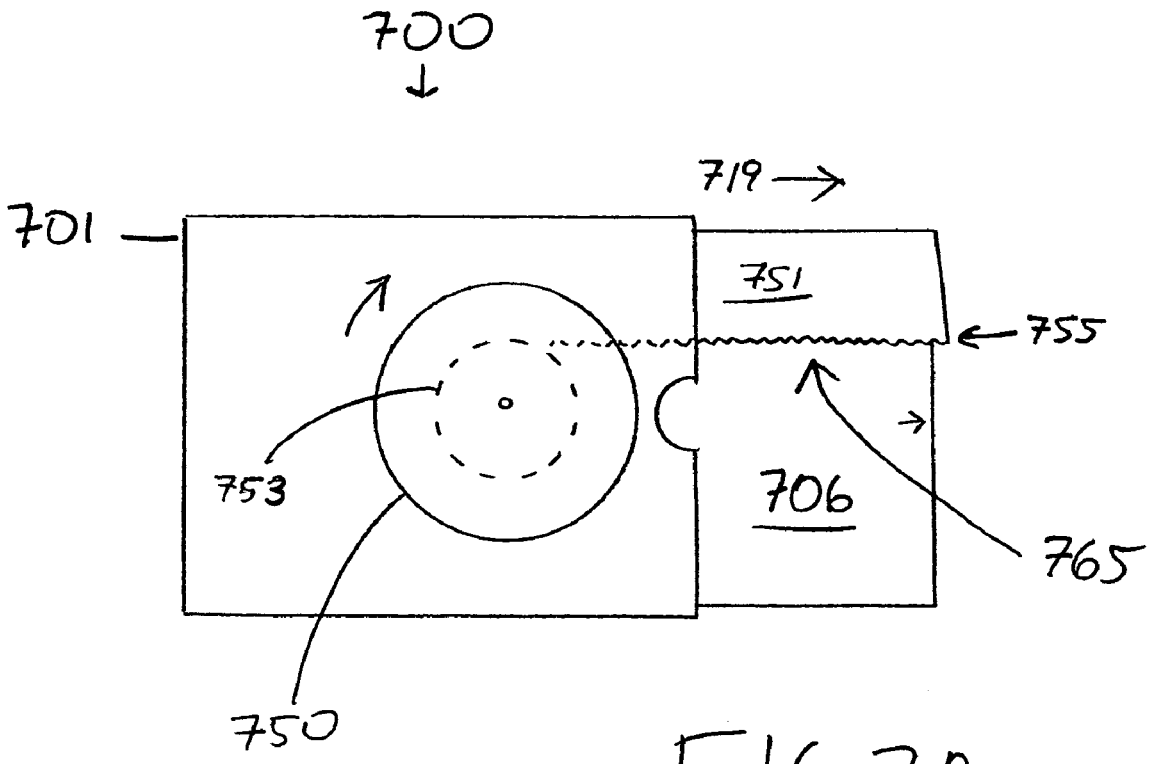
FIG. 7A is a plan view of the front side of the greeting card with the sliding panel partially pulled out according to the seventh embodiment.

FIG. 7A show a greeting card 700 according to a seventh embodiment. The greeting card 700 can substantially resemble the one shown in relation to FIG. 6A to 6C with at least these differences. The pulley 753 can have pinion gearing (not shown) and the sliding panel 706 can have rack gearing 765. This can allow the pulley 753 and the sliding panel 706 to function with rack-and-pinion gearing.

An advantage can be that production can be simplified. A disadvantage can be a lack of durability because the rack gearing 765 can potentially be damaged.

EIGHTH EMBODIMENT

Figure 8A:
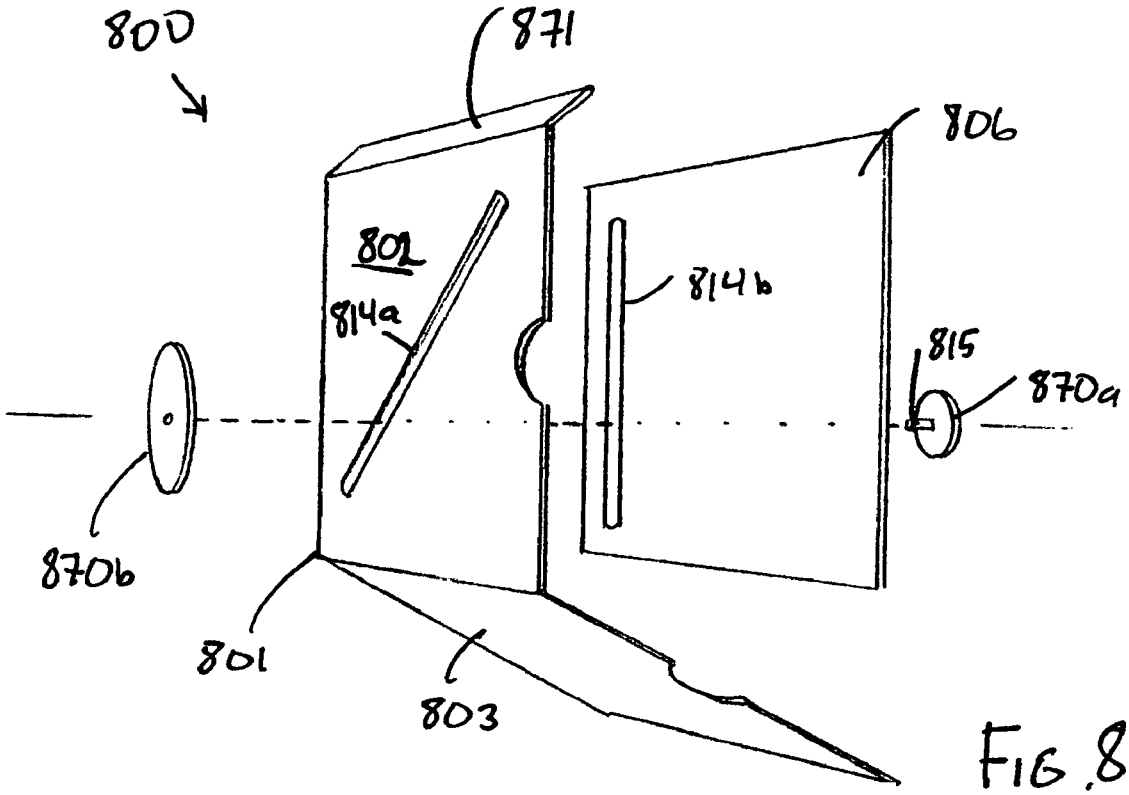
FIG. 8A is a perspective, exploded view of a greeting card according to the eighth embodiment.
Figure 8B:
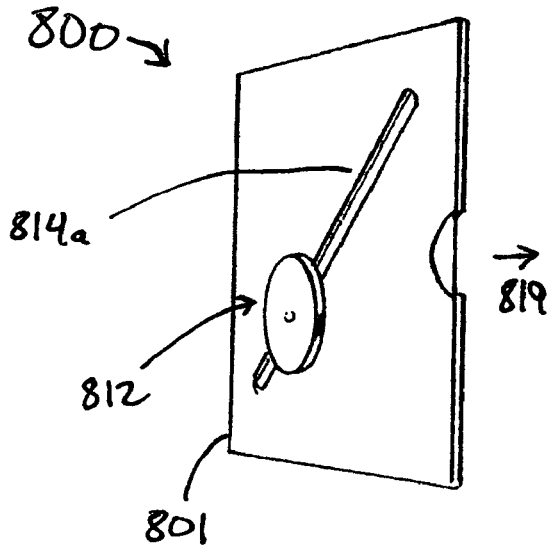
FIG. 8B is a perspective view of a-greeting card as assembled according to the eighth embodiment.

FIGS. 8A and 8B show a greeting card 800 according to an eighth embodiment. The greeting card 800 can substantially resemble, for example: the greeting card 100 shown in FIGS. 1A to 1H according to the first embodiment; the greeting card 400 shown in FIGS. 4A and 4B according to the fourth embodiment; or the greeting card 500 shown in FIGS. 5A to 5D according to the fifth embodiment.

Some of the similarities can be as follows: a display background such as a sleeve 801 comprising for, example, sheets 802, 803 (or walls 102, 103 as described in relation to the first embodiment); guides in the form of slots 814*a*, 814*b* (or a wire guide 109 as described in relation to the first embodiment); a movable member 806 (or a sliding panel 106 as described in relation to the first embodiment); or a slider 812. The slider 812 can incorporate a decorative object (not shown) or one can be attached to the slider 812. In addition, when actuated, in this instance by pushing or pulling on the movable member 806 (by hand or in other embodiments (not shown) by, for example, motorized means), the slider 812 can be moved. In addition, although not shown in FIGS. 8A and 8B, the slider 812 can have a decorative object (not shown) attached or incorporated into it.

The greeting card 800 (or, more generally, "display") can have differences. First, the slider 812 can consist of parts 870*a*, 870*b* that the end user can snap together. A first part 870*a* of the slider 812 can be positioned behind the movable member 806. A second part 870*b* of the slider 812 can be positioned in front of the front sheet 802. The first and second parts 870*a*, 870*b* can be connected by a shaft 815. The first slot 814*a* can be at an angle to the direction 819 of the movement of the movable member 806. The second slot 814*b* can be positioned perpendicular to the direction 819 of the movement of the movable member 806. In construction, the first and second parts 870*a*, 870*b* of the slider 812 can as shown in FIG. 8A be fastened to each other (with adhesive, with clips, etc. (not shown)) A flap 871 connected to the front sheet 802 can attach to the back sheet 803 of the sleeve 801 with adhesive, etc.

The configuration shown in FIGS. 8A and 8B can have several advantages. One advantage can be that the manner of construction can permit construction by the end user of the greeting card 800. For example, the greeting card 800 can be sold as part of a kit (not shown) requiring some assembly by the end user. The user could construct the greeting card 800 as shown in FIGS. 8A and 8B.

As part of the construction, a decorative object (not shown) could be attached to the second part 870*b* of the slider 812. (The end user could be presented with a selection of decorative objects in a kit.) For example, the user could attach a sticker (not shown) to the second part 870*b*. A sticker could be chosen from a selection included with the kit.

Alternatively, in another embodiment (not shown) a slider could be constructed from three or more pieces. A rivet could be used to connect two disks of, for example, card stock. An advantage of this construction method could be savings in manufacturing costs.

Another advantage of greeting card 800 and the embodiments discussed earlier can be the ease of manufacture. Pop-ups typically require a substantial amount of folding to assemble. This can result in a manufacturing process that is time-consuming, difficult to automate, and expensive on a per unit basis. The greeting card 800 and the earlier embodiments discussed above can have the advantage of being much simpler to manufacture and hence less costly.

Modifications

The embodiments or examples discussed above can be combined in various ways without departing from the invention. Moreover, the present invention should not be considered limited to the particular examples described above, but rather should be understood to cover all aspects of the invention as fairly set out in the claims arising from this application. For example, while suitable sizes, materials, packaging and the like have been disclosed in the above discussion, it should be appreciated that these are provided by way of example and not of limitation as a number of other sizes, materials, fasteners, and so forth may be used without departing from the invention. Various modifications as well as numerous structures to which the present invention may be applicable will be readily apparent to those of skill in the art to which the present invention is directed upon review of the present specifications. The claims which arise from this application are intended to cover such modifications and structures.

We claim:

1. A display comprising: a sleeve having a first guide; a movable member that moves in relation to the sleeve, the movable member having a second guide; a slider slidably secured to the first guide and slidably secured to the second guide; whereby movement of the member causes the first guide and the second guide to cooperate in directing movement of the slider; and the second guide comprises a wire attached to the member.

* * * * *